United States Patent [19]

Danckert et al.

[11] 4,324,208

[45] Apr. 13, 1982

[54] INTERNAL COMBUSTION ENGINE WITH A SOUND INSULATING CASING

[75] Inventors: Hermann Danckert; Helmut Leptien, both of Wolfsburg, Fed. Rep. of Germany

[73] Assignee: Volkswagenwerk Aktiengesellschaft, Wolfsburg, Fed. Rep. of Germany

[21] Appl. No.: 151,880

[22] Filed: May 21, 1980

Related U.S. Application Data

[63] Continuation of Ser. No. 952,488, Oct. 18, 1978, abandoned.

[30] Foreign Application Priority Data

Oct. 29, 1977 [DE] Fed. Rep. of Germany ..... 2746896

[51] Int. Cl.[3] ..... F02B 77/02

[52] U.S. Cl. ..... 123/195 C; 123/195 S; 123/198 E; 123/52 M; 123/41.7; 181/204

[58] Field of Search ..... 123/198 E, 195 C, 195 S, 123/41.7, 52 M; 181/204

[56] References Cited

U.S. PATENT DOCUMENTS

| | | | |
|---|---|---|---|
| Re. 29,923 | 3/1979 | Thien et al. | 123/41.7 |
| 3,521,726 | 7/1970 | Freyn | 123/195 C |
| 3,695,386 | 10/1972 | Thien et al. | 123/195 C |
| 3,949,726 | 4/1976 | List | 123/198 E |
| 3,951,114 | 4/1976 | Fachbach et al. | 123/198 E |
| 4,122,820 | 10/1978 | Ryberg | 123/198 E |
| 4,164,262 | 8/1979 | Statsche et al. | 123/41.7 |
| 4,257,368 | 3/1981 | Hofbauer | 123/198 E |

*Primary Examiner*—Ira S. Lazarus

*Attorney, Agent, or Firm*—Brumbaugh, Graves, Donohue & Raymond

[57] ABSTRACT

An internal combustion engine surrounded, at least in part, by a sound insulating casing. The casing is closed to the atmosphere with the exception of an inlet opening for receiving air for combustion in the engine. An air filter is coupled to the inlet opening for filtering the air passing through this opening into the interior of the casing.

7 Claims, 1 Drawing Figure

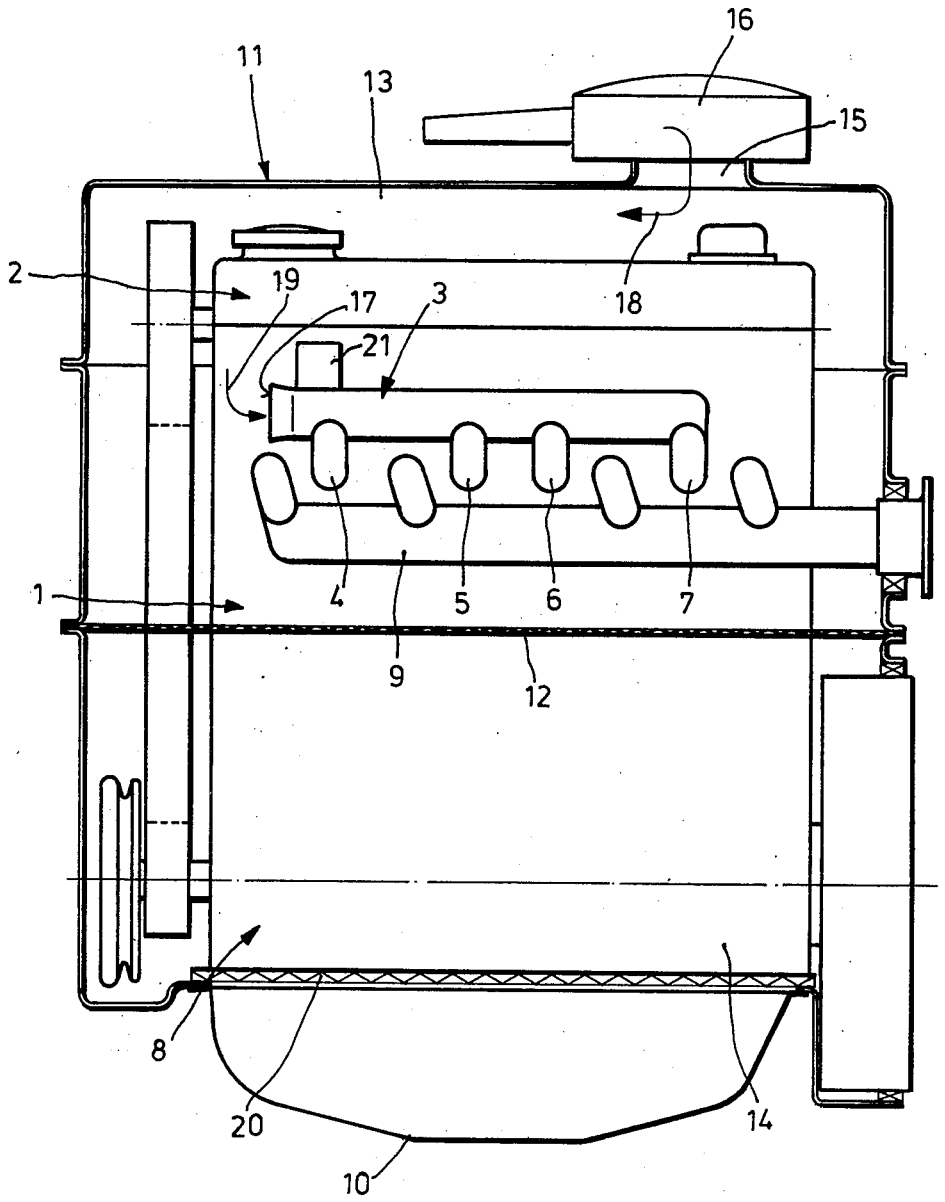
16
11
13
15
2
19
17
3
18
21
1
4
5
6
7
9
12
8
20
14
10

INTERNAL COMBUSTION ENGINE WITH A SOUND INSULATING CASING

This is a continuation, division, of application Ser. No. 952, 488 filed Oct. 18, 1978, now abandoned.

The present invention relates to an internal combustion engine that is surrounded, at least in part, by a sound insulating or sound absorbing casing.

It is known to surround internal combustion engines with a sound insulating casing. In such prior structures, means are provided to both ventilate and deventilate the space within the casing; that is, the casing is provided with at least one air inlet opening and one air outlet opening for the intake and discharge, respectively, of cooling air. In addition, the air required for combustion in the engine is drawn through the inlet opening.

It is also known to additionally or separately encase the parts of an internal combustion engine which exhibit a large heat emission, in particular the exhaust pipe which can also contain catalysts or the like. Even in this case it is necessary to supply cooling air to the engine casing interior since the casing also contains parts of the engine which need to be cooled, in particular the fuel metering device such as a carburetor, fuel pump or fuel injection system, and/or auxiliary devices such as the generator.

In all of these known encased engines, means are provided for passing a certain quantity of air through the casing interior. Fans or blowers are frequently used to accomplish this task.

The known, sound absorbing engine casings described above have principally two disadvantages in common: The presence of at least one air outlet opening, in addition to an inlet opening, has a deleterious effect on the desired sound insulation unless additional measures are taken, such as the placement of baffles in the region of the openings. In addition, the danger of contamination of parts of the internal combustion engine within the capsule increases with an increasing number of openings in the capsule and an increased quantity of air drawn in. It will be understood that dirt particles, water or snow will be drawn in with the air depending upon the particular existent conditions of the road upon which the vehicle, equipped with the encased engine, is travelling.

SUMMARY OF THE INVENTION

An object of the present invention is to provide an encapsulated engine unit which, without additional expense, improves the sound absorbing effect of the casing and reduces the danger of contamination.

This object, as well as further objects which will become apparent from the discussion that follows, are achieved, according to the present invention, by providing a casing which is closed to the atmosphere with the exception of an inlet opening, and providing an air filter, coupled to the inlet opening, for filtering air passing through this inlet opening into the interior of the casing.

In accordance with the invention, therefore, air is not permitted to pass through the casing in the sense of an air flow between intake openings and outlet openings. Rather, it has been found that the air quantity required for combustion in an internal combustion engine is sufficient to cool the vital parts of the engine, in particular the fuel metering device as well as auxiliary devices such as the generator.

In order to facilitate this cooling, the inlet opening of the casing and the inlet end of the intake pipe of the engine are preferably arranged on opposite sides of the parts of the engine which are to be cooled, so that the air which flows between the inlet opening and the inlet end of the intake pipe passes over these parts.

The danger of contamination of the internal combustion engine through dirt particles or the like carried along with the air is eliminated by the provision of an air filter for filtering the air passing through the inlet opening of the casing. With this arrangement, this air filter may replace the air filter customarily placed ahead (in the direction of air flow) of the intake pipe of the engine; i.e., this air filter constitutes the only means for filtering the air which enters the intake pipe. The absence of an air outlet opening in the casing also significantly reduces the danger of penetration of dirt particles or the like into the interior of the casing, in comparison with the flow-through type construction known in the art.

Depending upon the combustion air requirements of the internal combustion engine, it may be preferable, with the above described design, to thermally insulate-at least with respect to air flow-the encased space relative to parts of the internal combustion engine having large heat emission, such as the water jacket (in the case of a liquid cooled engine) and the oil pan. In a preferred embodiment of the invention, the casing also encloses at least some parts of the engine having large heat emission and further comprises an air lock dividing the interior space surrounded by the casing into a first space, containing parts of the engine having low heat emission, and a second space, containing parts of the engine having large heat emission. Parts such as the oil pan for which the danger of contamination is practically without importance may thus be cooled by utilizing the wind stream of the vehicle equipped with the engine. Suitably, the casing will be closed about the engine at the level at which the oil pan fastens to the engine block; that is, by providing an air tight connection between the casing and the engine at this point. It is also desirable to provide a sound insulating mounting between the oil pan and the motor block in order to maintain an enclosed capsule in the downward direction.

It is also possible to provide parts of the internal combustion engine having large heat emission, in particular the exhaust pipe of the engine, with an additional casing or with a water jacket.

For a better understanding of the invention, together with other and further objects, reference is made to the following description, taken in conjunction with the single FIGURE shown in the accompanying drawing.

BRIEF DESCRIPTION OF THE DRAWING

The single FIGURE shows a vertical section through an engine unit having a motor vehicle internal combustion engine surrounded by a sound insulating casing.

DESCRIPTION OF THE PREFERRED EMBODIMENT

The internal combustion engine is generally designated by 1 in the FIGURE. Its upper region 2, which is formed as a rule by one or more cylinder heads, includes an intake pipe 3 with a carburetor 21 as well as separate conduits 4 to 7 supplying the fuel-air mixture to the individual cylinders. The bottom portion 8 of the internal combustion engine contains the engine block with the exhaust line 9 and the oil pan 10.

In this exemplary embodiment, practically the entire internal combustion engine 1—with the exception of the oil pan 10 which is freely accessible to the wind stream—is surrounded by a casing 11. The capsule formed by the casing is divided into two sections by a diaphragm 12 arranged approximately at the height of the fastening plane of the cylinder head on the engine block. The diaphragm forms an air lock, dividing the capsule interior into an upper space 13 and a lower space 14. Considering first the upper space 13, this chamber has merely one opening, constituting an air inlet opening 15, which is provided with the air filter 16. This air filter may be furnished with sound-insulating inserts in a conventional manner to absorb the sound of the in-rushing air as well as the sound of the engine.

The air filter 16 also forms the filter that is customarily associated with the air intake pipe 3 of the internal combustion engine so that no separate air filter need be provided at the inlet end 17 of the intake pipe 3. As indicated by the arrows 18 and 19, the inlet opening 15 of the capsule and the inlet end 17 of the intake pipe 3 are placed on opposite sides of the engine, so that the combustion air that moves from the opening 15 to the inlet 17 sweeps over parts of the engine, such as the carburetor 21 or a fuel injection pump, that require cooling. It has been found that this air current, which is dimensioned by the combustion air requirements of the engine, is sufficient for cooling these parts of the engine.

Due to the presence of the air filter 16 at the air inlet opening 15 as well as the absence of air outlet openings, the casing 11 exhibits a maximum sound-insulating effect in the upper region 2 of the internal combustion engine. Moreover, it is impossible for dirt particles and moisture to penetrate into the encapsulated space 13.

Parts of the internal combustion engine giving off much heat, on the other hand, are located in lower space 14 which is closed off, at least with respect to air flow, relative to the upper space 13 by the diaphragm 12.

As indicated at 20, the oil pan 10 is connected with the engine block through a sound-insulating intermediate layer. Since the casing 11 is likewise connected with the internal combustion engine 1 at this point, thus providing a completely enclosed capsule on the downward side, it is also impossible for sound from the engine to radiate downwardly.

Due to the fact that the air quality supplied is limited to the quantity required for combustion, the necessity for fans is eliminated.

It is evident that in case of liquid cooling, the cooler or radiator will be located outside the casing 11.

While there has been described what is believed to be the preferred embodiment of the invention, those skilled in the art will recognize that various changes and modifications may be made thereto without departing from the spirit of the invention, and it is intended to claim all such embodiments as fall within the true scope of the invention.

We claim:

1. In an engine comprising:

(a) an internal combustion engine having, (1) at least one intake pipe for receiving air for combustion that has passed through an air filter, (2) at least one fuel metering device, and (3) at least one exhaust pipe; and (b) a sound insulating casing with at least one air inlet opening, which encloses a space adjacent to said engine which includes the region of said intake pipe; the improvement wherein said casing is closed to the atmosphere with the exception of the said inlet opening, wherein an air filter is coupled to said inlet opening for filtering air passing through said inlet opening into the interior of said casing, wherein said intake pipe comprises an intake manifold within said casing, said manifold having a single air intake for supplying air to a plurality of cylinders, and wherein said inlet opening and the air intake of said intake manifold are arranged in such a manner that the air which flows between said inlet opening and said air intake passes over and cools parts of said engine which are to be cooled.

2. The improvement recited in claim 1, wherein said air filter coupled to said inlet opening is the only means for filtering the air which enters said intake pipe.

3. The improvement recited in claim 1, wherein at least one of said parts to be cooled is the fuel metering device of said engine.

4. The improvement recited in any one of claims 1, 2 or 3 wherein parts of said engine having large heat emission are disposed outside said space, surrounded by said casing, said space containing parts of the engine having low heat emission.

5. The improvement recited in claims 1, 2 or 3 wherein said casing encloses parts of said engine having large heat emission and further comprising an air lock dividing said interior space surrounded by said casing into a first space containing parts of the engine having low heat emission and a second space containing parts of said engine having large heat emission.

6. The improvement recited in claim 5, wherein said air lock is a diaphragm.

7. The improvements specified in claim 1 wherein said engine extends in a longitudinal direction and wherein said air inlet opening and said air intake are at opposite longitudinal ends of said engine.

* * * * *

UNITED STATES PATENT AND TRADEMARK OFFICE

CERTIFICATE OF CORRECTION

PATENT NO. : 4,324,208

DATED : April 13, 1982

INVENTOR(S) : Hermann Danckert et al.

It is certified that error appears in the above—identified patent and that said Letters Patent is hereby corrected as shown below:

First page, Item [30], "2746896" should read --2748696--;
Col. 1, line 5, delete "division,".

Signed and Sealed this

*Twenty-second* Day of *June 1982*

[SEAL]

*Attest:*

GERALD J. MOSSINGHOFF

*Attesting Officer*

*Commissioner of Patents and Trademarks*